United States Patent [19]

Kurt et al.

[11] Patent Number: 4,938,432

[45] Date of Patent: Jul. 3, 1990

[54] CABLE SPOOL WITH INTEGRAL END STORAGE FLANGE

[75] Inventors: Jeffrey P. Kurt, Batavia, Ill.; James D. Holder, Tompkinsville, Ky.

[73] Assignee: Cooper Industries, Inc., Houston, Tex.

[21] Appl. No.: 336,859

[22] Filed: Apr. 12, 1989

[51] Int. Cl.[5] ..... B65H 75/18; B65H 75/28

[52] U.S. Cl. ..... 242/117; 242/125.1; 242/125.2

[58] Field of Search ..... 242/125.1, 125.2, 125, 242/117; 254/DIG. 14, 266, 278

[56] References Cited

U.S. PATENT DOCUMENTS

| | | | |
|---|---|---|---|
| 952,227 | 3/1910 | Bangle et al. | 242/125.1 |
| 1,314,658 | 9/1919 | Huber | 242/125.1 |
| 2,417,587 | 3/1947 | Damstra | 242/101 |
| 2,811,322 | 10/1957 | Wilkinson | 242/117 |
| 3,743,210 | 7/1973 | Hawley | 242/125.1 |
| 4,084,767 | 4/1978 | Witt | 242/164 |
| 4,387,863 | 6/1983 | Edmonston et al. | 242/118.4 |
| 4,602,751 | 7/1986 | Vogel | 242/118.4 |
| 4,657,203 | 4/1987 | Crawford | 242/125.1 |
| 4,715,549 | 12/1987 | Travlos | 242/25 |
| 4,715,557 | 12/1987 | Rushing et al. | 242/129 |
| 4,718,633 | 1/1988 | Weixel | 242/129 |

*Primary Examiner*—Stuart S. Levy
*Assistant Examiner*—William G. Battista, Jr.
*Attorney, Agent, or Firm*—Fitch, Even, Tabin & Flannery

[57] ABSTRACT

A cable spool has a cylindrical drum about which a length of cable is wound. A pair of end flanges connected to opposite ends of the cylindrical drum hold the cable on the cylindrical drum. One of the end flanges has an outer flange and an inner flange extension formed integrally therewith. A serpentine cable channel is formed in the inner flange and grips an end of the cable to prevent the cable from unwinding. The serpentine cable channel holds the cable end available for electrical or optical testing while holding it away from a periphery of the outer flange where the cable might be damaged by unwanted contact with an abrasive surface.

5 Claims, 1 Drawing Sheet

CABLE SPOOL WITH INTEGRAL END STORAGE FLANGE

BACKGROUND OF THE INVENTION

The invention relates in general to a storage flange for an electrical and/or optical cable and in particular, to a cable spool having an integral end storage flange spaced away from a periphery of an outer end flange for holding a cable end available for testing, but out of contact with a surface upon which the spool is positioned.

It is well known that cable, in particular communications cable, whether having electrical conductors or fiber optic waveguides therein, is commonly stored on spools prior to and sometimes during use. Conventional spools for storing communications cable, however, suffer from a number of shortcomings. For instance, cable is typically wound about a cylindrical drum of a spool in multiple layers. The static coefficient of friction between the surface of the cable and the drum surface, as well as among the various cable surfaces brought into contact with each other when the cable is wound, effectively prevents the cable from being removed from the drum by any method other than unwinding. It should be appreciated, however, that when the cable is almost completely unwound from the drum, for instance when there is only a portion of one winding layer of cable remaining on the drum, the drum is held locked and a relatively large tensile force is applied to the cable, the cable may slide free of the drum. If the cable is being strung directly from the cable spool and it is necessary to hold it in tension, this, of course, can lead to difficulties in its installation.

One of the methods of preventing cable slippage on the drum is to anchor the cable by taking a first or inner end of the cable and drawing it through an aperture either in the drum or in the flange of the drum, as is disclosed in U.S. Pat. No. 2,811,322. Other patents, for instance, U.S. Pat. Nos. 3,743,210, 4,084,767, 4,387,863 and 4,715,549, disclose spools having means for locking the end of the cable to a flange. While those cable spools, which adequately anchor the cable and spools such as that shown in U.S. Pat. No. 2,417,587 to Damstra may hold an end of the cable firmly with respect to the cylindrical drum, the inner cable end is left exposed. If the reel or spool is placed on a surface, the end of the cable may be brought into contact with the surface where it may become abraded or damaged. While, for certain types of flexible tension members such as the clothesline of U.S. Pat. No. 2,417,587, this presents little problem, delicate communications cables, in particular those having optical fibers and especially single mode optical fibers, may be damaged quite easily by unwanted abrasive contact with surfaces which may render the fibers useless. The prior art cable spool constructions fail to protect the fixed end of the cable because they allow it to be contacted by outside agents.

By the same token, since the type of cable being discussed is communications cable, it is often desirable, if not necessary, to test the cable as it is being installed. For instance, fiber optic communication cable may be unrolled from the cable spool and connected to a repeater or to another cable via a fiber optic coupler. If the ends of the optical fibers are not aligned with each other precisely, the light losses in the coupler may be so great that they render the connection useless. One way to test for such losses is to inject a signal into the inner end of the cable in order to measure the effective impedance of the joint of the cable with another cable or device. Thus, it is important that the inner end of the cable be held available for connection while substantially shielding it from unwanted contact which may damage it. Unfortunately, none of the prior art cable spools are able to perform these multiple functions.

What is needed is a cable spool which firmly anchors an inner end of the cable to the spool and protects the inner end from damage while providing ready and easy access to the inner end to allow the cable to be electrically or optically tested quickly and easily.

SUMMARY OF THE INVENTION

The invention is directed generally to a cable spool which firmly anchors an end of a communication cable, such as an optical fiber containing cable, to itself. The cable protects the end of the optical fiber cable from damage caused by abrasion or contact with extraneous materials. The spool also holds the end of the cable in a protected but somewhat exposed orientation allowing easy access to test equipment and fixtures for electrically or optically testing the cable as it is being joined or assembled with other components.

The invention, in particular, is directed to a cable spool having a substantially cylindrical drum with a drum surface. The cable spool has connected to it a pair of drum ends with circular outer flanges for preventing a communication cable wound on the drum from escaping from the drum. An inner flange extension is formed integral with each of the outer flanges. Both of the inner flange extensions have a reduced radius with respect to the outer flanges and one of them has a serpentine or S-shaped cable channel formed therein for frictionally engaging an inner end of the cable. The serpentine cable channel holds the cable away from a periphery of the outer circular flange where it might be damaged, while making the cable available for electrical or optical testing. It may be appreciated that the present configuration provides a superior arrangement over cable spools which secure the inner end of the cable by trapping it in an aperture in an end flange. Such a cable spool might allow handling equipment, such as forklift trucks, to contact and damage the cable end. The inventive cable spool shields the innner end from such damaging contact.

It is a principal aspect of the present invention to provide a cable spool with an integral end storage flange for protecting an end of a communication cable.

It is another aspect of the instant invention to provide a cable spool with an integral end storage flange which secures an inner end of a cable to the flange while holding it available for electrical or optical testing.

Other aspects and uses of the present invention will become apparent to one of ordinary skill in the art upon a perusal of the specification and claims in light of the accompanying drawings.

DETAILED DESCRIPTION OF THE PREFERRED EMBODIMENT

Figure 1:
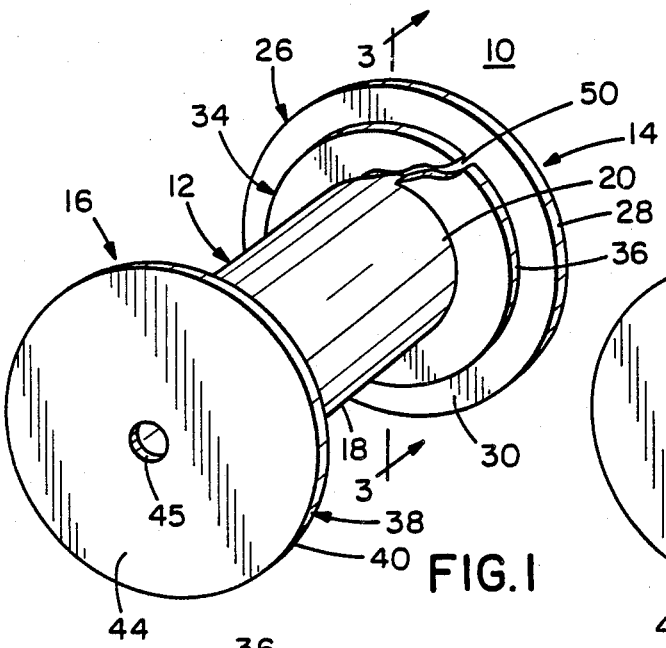
FIG. 1 is an isometric view of a cable spool embodying various features of the present invention.
Figure 2:
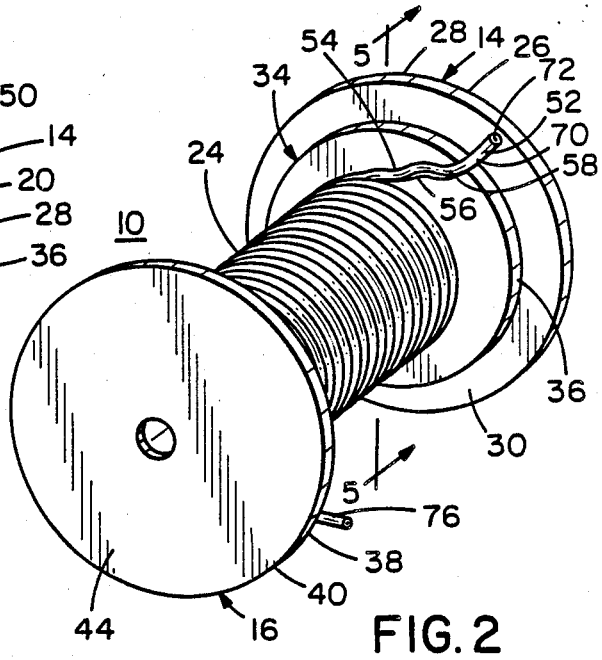
FIG. 2 is an isometric view of the cable spool of FIG. 1 having a single layer of communication cable wound thereon with an end of the cable frictionally engaged in a serpentine cable channel formed in an inner flange.

Referring now to the drawings and especially to FIGS. 1 and 2, a cable spool embodying the present invention and generally identified by numeral 10 is shown therein. The cable spool 10 includes a right circular cylindrical drum 12 having a first end flange 14 and a second end flange 16 connected to it. In the present embodiment, the cylindrical drum 12 has a length of about fourteen and one half inches.

The drum 12 with a right circular cylindrical shape has a cable winding wall 18 which terminates at a first cylinder end 20. The cable winding wall 18 also terminates at a second cylinder end positioned opposite the first cylinder end 20. The cylindrical cable winding wall 18 receives a length of cable 24 wound around it. The cable 24 may be an electrical communication cable or an optical communication cable having one or more multi-mode or single mode optical fibers therein with a protective outer jacket 25 of resilient material such as polyvinylchloride (PVC). The first end flange 14 is connected to the first cylinder end 20 by gluing or a snap-fitting. The second end flange 16 is connected to the second cylinder end by gluing or snap-fitting.

The first end flange 14, as may best be seen in FIGS. 1, 2, 3 and 5, has a circular outer flange 26, having a diameter of twenty four inches and a width of three-fourths of an inch. The outer flange 26 has a circular periphery 28, an inside face 30 and an outside face 32. An integrally formed circular inner flange 34, having a diameter of eighteen inches and a width of one-half inch, is connected to the outer flange 26 at the inside face 30. The inner flange 34 terminates at an inner flange edge 36 and has a diameter which is less than the diameter of the outer flange 26. The second end flange 16 has a circular outer flange 38 having a diameter of twenty four inches and a width of three-fourths of an inch. The second end outer flange 38 has a circular periphery 40, an inside face (not shown), an outside face 44 and an arbor hole 45. The arbor hole 45 has a diameter of seven-eighths of an inch. An integrally formed inner flange (not shown), having a diameter of eighteen inches and a width of one-half inch, is connected to the outer flange 38 at the inside face. The inner flange terminates at an inner flange edge and has a diameter which is less than the diameter of the circular outer flange 38. The invention will be described with specific reference to first end flange 14, but it is apparent that either end flange may be utilized.

The inner flange 34 of first end flange 14 has a serpentine cable channel 50 formed therein for frictionally engaging an inner end 52 of the communication cable 24 therein. More specifically, the width of the serpentine cable channel 50, which in this embodiment is a maximum of one half inch, is slightly less than the outer diameter of the resilient outer jacket 25 of the communication cable 24. A typical width of the serpentine cable channel 50 is about three-eighths of an inch or slightly less. A width of slightly less than three-eighths of an inch allows cable having a diameter of three-eighths of an inch to be press-fit into the serpentine cable channel 50 where it is frictionally held. Thus the fixed end 52 of the communication cable 24 is frictionally held by the serpentine cable channel 50.

Figure 3:
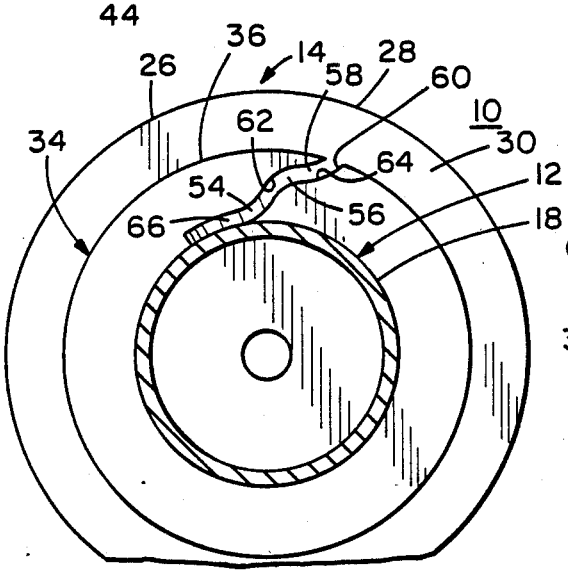
FIG. 3 is a section having a portion broken away and taken substantially along line 3—3 of FIG. 1 showing details of the serpentine cable channel formed in the inner flange and the manner in which it engages the end of the communication cable wound thereabout.
Figure 4:
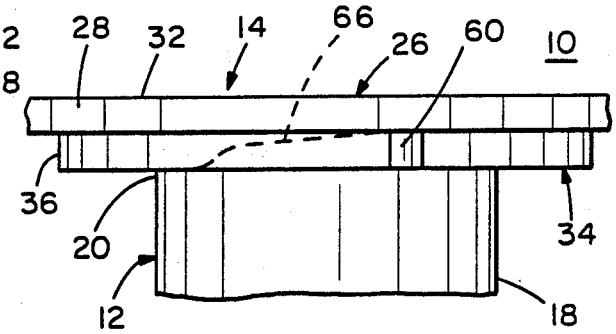
FIG. 4 is an elevation of a portion of the cable spool of FIG. 1 showing details of the serpentine channel and its relationship with the end flange.

The serpentine cable channel 50 has a first curved portion 54 which is substantially tangential to the winding wall 18 (of FIG. 3). The serpentine cable channel 50 has a second curved portion 56, a third curved portion 58 and an exit port 60. All of the portions of the serpentine channel are defined by a first side wall 62, a complementary second side wall 64, a ramp surface 66 and the inside face 30 of the outer flange 26. The ramp surface 66, which defines part of the first curved portion 54, provides a gradual interface between the cylinder wall 18 and the second curved portion 56 of the serpentine cable channel 50, as may best be seen in FIGS. 4 and 6. It may be appreciated that the exit port 60 is coterminous with the inner flange edge 36.

Figure 5:
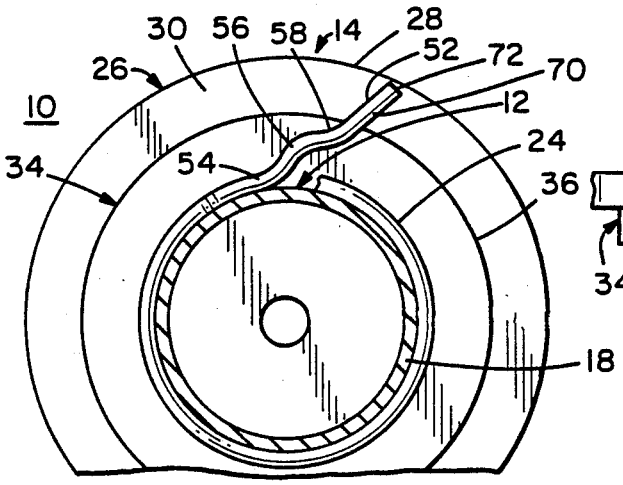
FIG. 5 is a section similar to FIG. 3 and showing details of the frictional engagement of the cable end of FIG. 2 with the serpentine cable channel.
Figure 6:
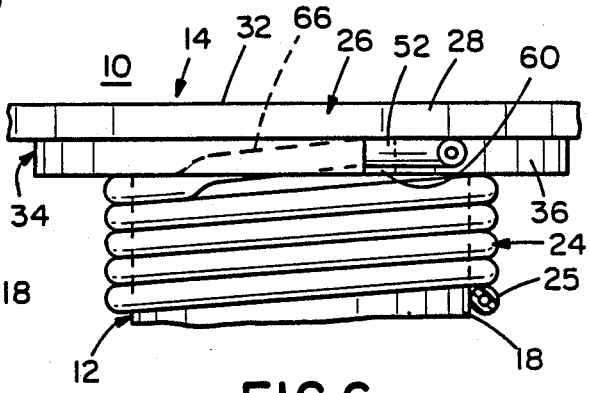
FIG. 6 is an elevation of a portion of the loaded cable spool of FIG. 2 showing details of the frictional engagement of the cable end by the serpentine cable channel.

Thus, the communication cable 24 has its inner end 52 frictionally press-fitted into the serpentine channel 50 where it is held therein, as may best be seen in FIGS. 2, 5 and 6. It may be appreciated that if a tensile force is applied to the end 52 the outer jacket 25 will be forced into more secure engagement with the walls of the serpentine channel 52, causing the communication cable 24 to be held more securely therein. The serpentine cable channel 50 locks the cable end 52 when the tensile force is applied.

A cable stub 70 having an end 72 extends a short distance from the exit port 60. The cable stub 70 does not extend beyond the periphery 28 of the outer flange 26. Thus, the cable end 72 is positioned out of contact with any surfaces upon which the cable spool 10 is resting. This prevents the cable end 72 from contacting those surfaces where it may be abraded and damaged. Such abrasion may be particularly serious if the cable 24 contains single mode optical fibers since the single mode optical fibers may be damaged to the point where they cannot be used.

At the same time the cable end 72, while protected, is made available for electrical or optical testing so that if a free end 76 in FIG. 2 of the cable 24 is connected to an electrical device or network, a signal may be injected into the network at the cable end 72 or a signal may be sensed at the cable end 72 merely by attaching an appropriate piece of test equipment. Even though the cable end 72 is available for testing, the serpentine cable channel 50 frictionally engages the cable 24 in a firm gripping fashion due to the contiguous placement of the oppositely curved sections 54, 56 and 58 of the serpentine path. Thus, the cable 24 is firmly held within the serpentine cable channel 50 and does not slip on the cylindrical drum 12 even when almost all of the cable 24 has been unwound from it.

It may be appreciated that the instant invention provides an apparatus and a method for securing the cable 24 by winding it around the cylindrical drum 12 and frictionally engaging it in the serpentine cable channel 50. While strongly held to the cable spool 10 so that it does not slip free, the end 72 of the cable 12 is made available for electrical or optical testing while it is simultaneously held out of contact with a surface upon which the cable spool 10 rests.

While there has been illustrated and described a particular embodiment of the present invention, it will be appreciated that numerous changes and modifications will occur to those skilled in the art and it is intended in the appended claims to cover all those changes and modifications which fall within the true spirit and scope of the present invention.

What is claimed is:

1. A cable spool comprising:

a cylindrical drum with a first end and a second end having a longitudinal axis and drum surface around which a length of cable may be wound for storage;

a first end flange and a second end flange mounted on said drum at each of said first and second drum ends, respectively, at least one of said first and second end flanges having an outer flange with an outer flange periphery for preventing the length of cable from escaping the cylindrical drum and, an inner flange between the one of said first and second drum end and the outer flange, said inner flange approximately perpendicular to said longitudinal axis and having a reduced radial extension with respect to the outer flange;

the inner flange defining an S-shaped serpentine cable channel generally extending radially outward from said drum surface, said channel operable to receive and frictionally engage an end of the length of cable to hold the cable within the periphery of the outer flange.

2. A cable spool as defined in claim 1, wherein the serpentine cable channel has a first end positioned adjacent to the cylindrical drum and oriented substantially tangentially with the drum surface.

3. A cable spool as defined in claim 1, wherein the serpentine channel has a width less than an outer diameter of an outer jacket of the cable to grip the outer jacket of the cable resiliently therein.

4. A cable spool as claimed in claim 1 wherein said outer flange has an inner face cooperating with said inner flange to define said serpentine cable channel.

5. A cable spool for winding storage of a length of cable, said spool comprising:

a cylindrical drum with a longitudinal axis having a drum surface, a first drum end and a second drum end;

said cable having a first cable end and a second cable end;

a first end flange and a second end flange, each of said first and second end flanges having an outer flange with a first diameter and an inner flange with a second diameter less than said first diameter, each of said inner and outer flanges having an outer periphery;

one of said first and second end flanges normally mounted at its inner flange on one of said first and second drum ends and the other of said first and second end flanges normally mounted at its inner flange on the other of said first and second drum ends; and and least one of said first and second end-flange inner flanges defining an S-shaped serpentine cable channel generally extending radially outward from said drum surface and operable to receive and frictionally retain one of the first and second cable ends between said inner flange and outer flange outside peripheries.

* * * * *